US006463680B1

(12) United States Patent
Myers

(10) Patent No.: US 6,463,680 B1
(45) Date of Patent: Oct. 15, 2002

(54) SHOE DEVICE

(76) Inventor: Kathey D. Myers, 1310 Sally Dr., Picayune, MS (US) 39466

( * ) Notice: Subject to any disclaimer, the term of this patent is extended or adjusted under 35 U.S.C. 154(b) by 0 days.

(21) Appl. No.: 09/991,030

(22) Filed: Nov. 21, 2001

(51) Int. Cl.[7] ..... A43B 13/18; A43B 3/12

(52) U.S. Cl. ..... 36/28; 36/7.8; 36/27; 36/11.5; 36/140

(58) Field of Search ..... 36/7.8, 27, 28, 36/151, 11.5, 140

(56) References Cited

U.S. PATENT DOCUMENTS 298,844 A * 5/1884 Glanville ..... 36/28
457,408 A * 8/1891 Straub ..... 36/28
1,144,188 A * 6/1915 Gerlach ..... 36/28
2,043,396 A 6/1936 Schellbacher
2,413,545 A * 12/1946 Cordi ..... 116/67 R
2,710,460 A 6/1955 Stasinos
2,721,400 A * 10/1955 Isreal ..... 36/169
D201,372 S 6/1965 Dobson
4,296,557 A 10/1981 Pajevic
4,638,575 A * 1/1987 Illustrato ..... 36/28
5,343,637 A 9/1994 Schindler
5,513,448 A * 5/1996 Lyons ..... 36/27
5,649,373 A * 7/1997 Winter et al. ..... 36/28
5,671,552 A * 9/1997 Petibone et al. ..... 36/27
6,006,449 A * 12/1999 Orlowski et al. ..... 36/27
6,055,747 A 5/2000 Lombardino
6,282,814 B1 * 9/2001 Krafsur et al. ..... 36/27

* cited by examiner

*Primary Examiner*—Ted Kavanaugh

(57) ABSTRACT

A shoe device for offsetting the affects of nerve injuries. The shoe device includes a sole having an upper surface, a lower surface, a front end and a back end. A peripheral edge extends between the upper and lower surfaces. The sole has a toe portion, ball portion and heel portion. The sole has a chamber positioned therein. An upper portion is attached to the peripheral edge of the hole for receiving a portion of the foot for removably securing the foot to the sole. A plurality of biasing members is positioned in the chamber for biasing the upper surface away from the lower surface.

3 Claims, 1 Drawing Sheet

SHOE DEVICE

BACKGROUND OF THE INVENTION

1. Field of the Invention

The present invention relates to shoes and more particularly pertains to a new shoe device for offsetting the affects of nerve injuries.

2. Description of the Prior Art

The use of shoes is known in the prior art. More specifically, shoes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,710,460; 6,055,747; 5,343,637; 2,043,396; U.S. Des. Pat. No. 201,372; and U.S. Pat. No. 4,296,557.

While these devices fulfill their respective, particular objectives and requirements, the aforementioned patents do not disclose a new shoe device. The inventive device includes a sole having an upper surface, a lower surface, a front end and a back end. A peripheral edge extends between the upper and lower surfaces. The sole has a toe portion, ball portion and heel portion. The sole has a chamber positioned therein. An upper portion is attached to the peripheral edge of the hole for receiving a portion of the foot for removably securing the foot to the sole. A plurality of biasing members is positioned in the chamber for biasing the upper surface away from the lower surface.

In these respects, the shoe device according to the present invention substantially departs from the conventional concepts and designs of the prior art, and in so doing provides an apparatus primarily developed for the purpose of offsetting the affects of nerve injuries.

SUMMARY OF THE INVENTION

In view of the foregoing disadvantages inherent in the known types of shoes now present in the prior art, the present invention provides a new shoe device construction wherein the same can be utilized for offsetting the affects of nerve injuries.

The general purpose of the present invention, which will be described subsequently in greater detail, is to provide a new shoe device apparatus and method which has many of the advantages of the shoes mentioned heretofore and many novel features that result in a new shoe device which is not anticipated, rendered obvious, suggested, or even implied by any of the prior art shoes, either alone or in any combination thereof.

To attain this, the present invention generally comprises a sole having an upper surface, a lower surface, a front end and a back end. A peripheral edge extends between the upper and lower surfaces. The sole has a toe portion, ball portion and heel portion. The sole has a chamber positioned therein. An upper portion is attached to the peripheral edge of the hole for receiving a portion of the foot for removably securing the foot to the sole. A plurality of biasing members is positioned in the chamber for biasing the upper surface away from the lower surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe device apparatus and method which has many of the advantages of the shoes mentioned heretofore and many novel features that result in a new shoe device which is not anticipated, rendered obvious, suggested, or even implied by any of the prior art shoes, either alone or in any combination thereof.

It is another object of the present invention to provide a new shoe device which may be easily and efficiently manufactured and marketed.

It is a further object of the present invention to provide a new shoe device which is of a durable and reliable construction.

An even further object of the present invention is to provide a new shoe device which is susceptible of a low cost of manufacture with regard to both materials and labor, and which accordingly is then susceptible of low prices of sale to the consuming public, thereby making such shoe device economically available to the buying public.

Still yet another object of the present invention is to provide a new shoe device which provides in the apparatuses and methods of the prior art some of the advantages thereof, while simultaneously overcoming some of the disadvantages normally associated therewith.

Still another object of the present invention is to provide a new shoe device for offsetting the affects of nerve injuries.

Yet another object of the present invention is to provide a new shoe device which includes a sole having an upper surface, a lower surface, a front end and a back end. A peripheral edge extends between the upper and lower surfaces. The sole has a toe portion, ball portion and heel portion. The sole has a chamber positioned therein. An upper portion is attached to the peripheral edge of the hole for receiving a portion of the foot for removably securing the foot to the sole. A plurality of biasing members is positioned in the chamber for biasing the upper surface away from the lower surface.

Still yet another object of the present invention is to provide a new shoe device that helps a wearer lift their foot to reduce incidents of tripping, stumbling and falling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
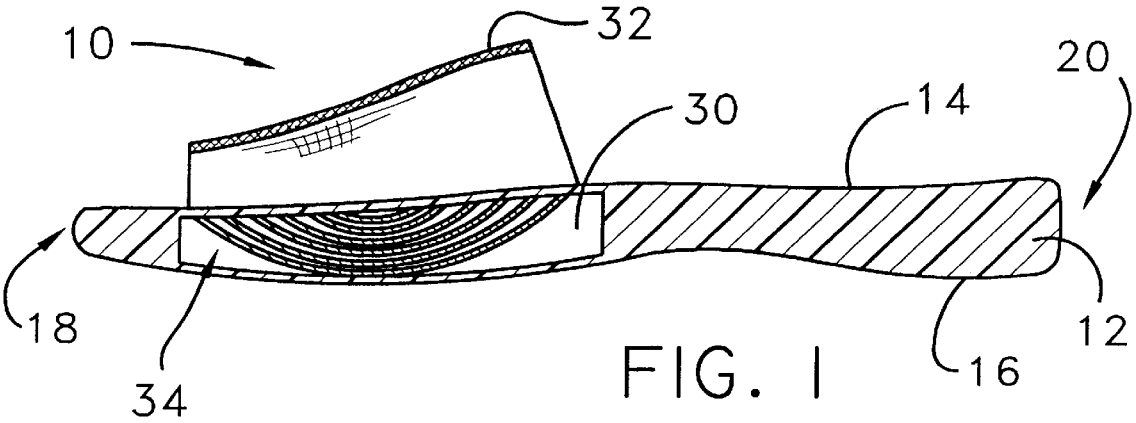
FIG. 1 is a schematic side cross-sectional view of a new shoe device according to the present invention.
Figure 2:
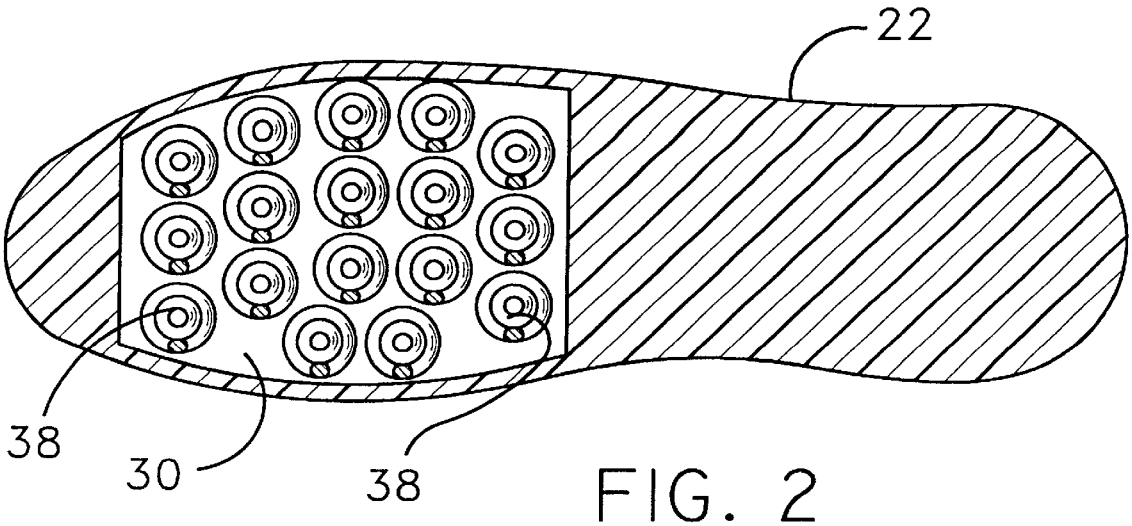
FIG. 2 is a schematic bottom cross-sectional view of the present invention.
Figure 3:
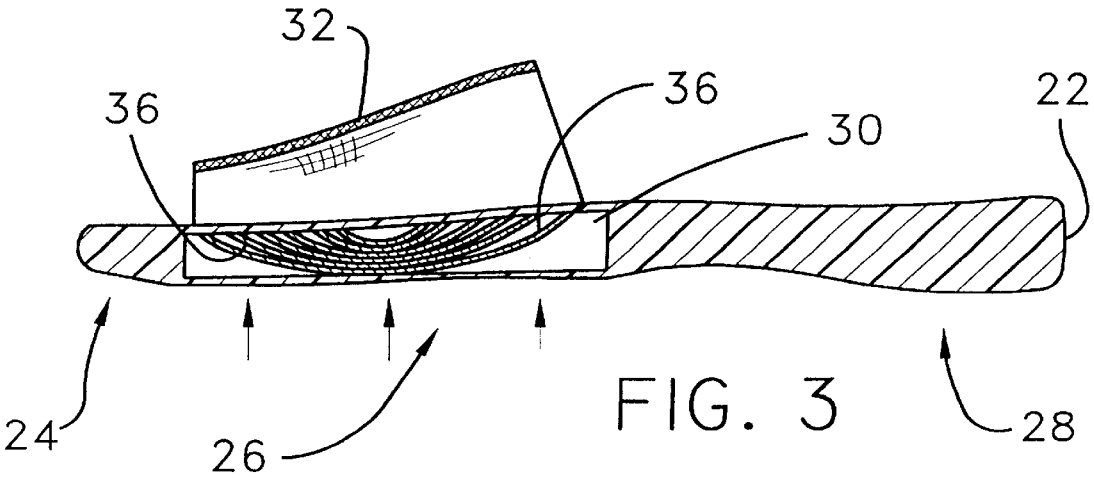
FIG. 3 is a schematic side cross-sectional view of the present invention.

With reference now to the drawings, and in particular to FIGS. 1 through 3 thereof, a new shoe device embodying the principles and concepts of the present invention and generally designated by the reference numeral 10 will be described.

As best illustrated in FIGS. 1 through 3, the shoe device 10 generally comprises a sole 12 having an upper surface 14, a lower surface 16, a front end 18 and a back end 20. A peripheral edge 22 extends between the upper 14 and lower 16 surfaces. The sole 12 has a toe portion 24, ball portion 26 and heel portion 28 with respect to a foot. The sole 12 has a chamber 30 positioned therein positioned in the ball portion 26.

An upper portion 32 is attached to the peripheral edge 22 of the sole 12 and extends over at least a portion of the upper surface 14. The upper portion 32 acts as a receiving member and adapted for receiving a portion of the foot for removably securing the foot to the sole 12.

A plurality of biasing members 34 is positioned in the chamber 30 for biasing the upper surface 14 away from the lower 16 surface. The biasing members 34 comprise a plurality of springs. The springs are preferably a plurality of leaf springs 36, however coil springs 38 are also envisioned.

In use, the device 10 is to be used primarily for those persons suffering from maladies such as peroneal nerve palsy which results in foot drop. The device, when worn, helps the user raise the foot during ambulation to offset the affects of the nerve condition.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A therapeutic shoe for aiding in the lifting of a foot, said shoe comprising:

a sole having an upper surface, a lower surface, a front end and a back end, a peripheral edge extending between said upper and lower surfaces, said sole having a toe portion, ball portion and heel portion, said sole having a chamber positioned therein;

an upper portion being attached to said peripheral edge of said sole for receiving a portion of the foot for removably securing said foot to said sole;

a plurality of leaf springs being positioned in said chamber for biasing said upper surface away from said lower surface; and said leaf springs being nested and positioned such that a central portion of a largest one of said leaf springs is adjacent said lower surface and a central portion of a smallest one of said leaf springs is positioned facing said upper surface whereby edges of each of said leaf springs provide support at spaced intervals along said upper surface.

2. The therapeutic shoe as in claim 1, wherein said chamber is positioned in said ball portion.

3. A therapeutic shoe for aiding in the lifting of a foot, said shoe comprising:

a sole having an upper surface, a lower surface, a front end and a back end, a peripheral edge extending between said upper and lower surfaces, said sole having a toe portion, ball portion and heel portion, said sole having a chamber positioned therein, said chamber being positioned in said ball portion;

an upper portion being attached to said peripheral edge of said sole and extending over at least a portion of said upper surface, said upper portion being adapted for receiving a portion of the foot for removably securing said foot to said sole;

a plurality of biasing members being positioned in said chamber for biasing said upper surface away from said lower surface, said biasing members comprising a plurality of springs, said springs being a plurality of leaf springs; and said leaf springs being nested and positioned such that a central portion of a largest one of said leaf springs is adjacent said lower surface and a central portion of a smallest one of said leaf springs is positioned facing said upper surface whereby edges of each of said leaf springs provide support at spaced intervals along said upper surface.

* * * * *